US006419022B1

(12) United States Patent
Jernigan et al.

(10) Patent No.: US 6,419,022 B1
(45) Date of Patent: Jul. 16, 2002

(54) RETRIEVABLE ZONAL ISOLATION CONTROL SYSTEM

(76) Inventors: Kerry D. Jernigan, 11407 Montverde, Houston, TX (US) 77099; Mark S. Crawford, 5107 Paystone La., Houston, TX (US) 77069

( * ) Notice: Subject to any disclaimer, the term of this patent is extended or adjusted under 35 U.S.C. 154(b) by 0 days.

(21) Appl. No.: 09/141,614

(22) Filed: Aug. 26, 1998

Related U.S. Application Data

(60) Provisional application No. 60/059,055, filed on Sep. 16, 1997.

(51) Int. Cl.[7] ..... E21B 43/12

(52) U.S. Cl. ..... 166/336; 166/53; 166/66.6

(58) Field of Search ..... 166/336, 344, 166/363, 366, 50, 52, 53, 54.1, 65.1, 66.5, 66.6

(56) References Cited

U.S. PATENT DOCUMENTS 4,936,139 A * 6/1990 Zimmerman et al. ..... 175/40 X
5,547,029 A * 8/1996 Rubbo et al. ..... 166/375
5,887,657 A * 3/1999 Bussear et al. ..... 166/336
5,934,371 A * 8/1999 Bussear et al. ..... 166/53

* cited by examiner

*Primary Examiner*—Roger Schoeppel
(74) *Attorney, Agent, or Firm*—Moser, Patterson & Sheridan, L.L.P.

(57) ABSTRACT

A system for controlling fluid flow from multiple isolated producing zones in a well is provided. Components of the system are placeable in and retrievable from bottom entry side pocket mandrel sections permanently installed in a production tubing string in the well. These components provided are sensor modules, isolation valve modules, power modules, control modules, hydraulic pump control modules and packer modules which are carried by the production tubing string. Control signals for modules are developed either downhole or at the surface and modules may be placed or retrieved through the production tubing without pulling the production tubing from the well.

26 Claims, 6 Drawing Sheets

RETRIEVABLE ZONAL ISOLATION CONTROL SYSTEM

RELATED APPLICATION

This application corresponds to Provisional Application Ser. No. 60/059,055 filed Sept. 16, 1997 and claims benefit under 35 U.S.C. 119(e) for this application.

FIELD OF THE INVENTION

This invention relates generally to the of hydrocarbons from wells and also to the sensing of the various pressures and control of flow of fluids that are present in wells that have been completed for hydrocarbon production. By hydrocarbon it is intended to mean oil, gas, and gas condensate. More particularly, the present invention concerns wells that have been drilled to various, perhaps multiple, isolated subsurface zones, including wells having lateral deviated branches to specific subsurface zones and for selectively controlling the production of hydrocarbon products from those zones by controlling the selective opening and closing of isolation valves that may be located in the main wellbore, branch wellbores or both.

BACKGROUND OF THE INVENTION

In the past, most wellbores for production of petroleum products were drilled substantially vertically from the surface for intersection of a subsurface potential hydrocarbon producing zone of interest. More recently, well drilling practices have been modified to drill deviated wellbores from a particular surface location, such as in an offshore drilling and production platform, for example. In this case, each well drilled from the platform is typically drilled vertically to a desired depth and then is deviated at an angle to a potential hydrocarbon production zone of interest. Deviated wellbores may also be drilled horizontally or near horizontally from a vertical or near vertical wellbore, so as to intersect a zone of interest and to ensure the location of a substantial length of the wellbore within the selected subsurface formation, such as a hydrocarbonaceous formation, for example. Typically, for the drilling of deviated and substantially horizontal wellbores wide use is made of drilling using mud motors which are energized by flowing drilling fluid. The mud motors, especially in the case of horizontal wellbores are typically connected to a flexible coiled tubing which is not rotated within the wellbore during drilling. The flexible coiled tubing through which drilling mud is pumped, simply is moved linearly through the wellbore and the rotating mud motor and its drill bit progress through the subsurface formation being drilled.

Even more recently, wells have been drilled and completed to multiple zones of interest by drilling a primary wellbore, which may be typically but not necessarily vertically oriented and by then drilling one or more lateral branch wellbores that deviate from the primary wellbore and intersect particular zones of interest. In this manner, a single well can be drilled and two or more isolated potential hydrocarbon producing zones of interest may be produced from the single well. The production fluid of one zone can be kept separate from the production fluid of another zone if such is desired by zonal isolation. Zonal isolation refers to the separation from the production tubing of the isolated production fluid from zones in a cased or open wellbore. This is usually accomplished by the use or packers of plugs set within the casing, or in an open hole section, to prevent fluid communication via the casing or the borehole from one such zone to another.

Where multiple zones of interest are intersected by offset or branch bores from a primary wellbore, it is often desirable to complete the well in each of the subsurface hydrocarbon production zones of interest, but to insure that each zone of interest is maintained completely isolated from other zones of interest. The separated zones are each completed into the branch bores or into separate production tubing extending from the primary wellbore or the surface. The present invention is directed to a retrievable zonal isolation control system for use in wells of this nature, wherein each of several production zones may be selectively and independently produced by selectively controlling the open and closed positions of isolation valves that are provided for each of the subsurface zones.

SUMMARY OF THE INVENTION

It is a feature of the present invention to provide a novel zonal isolation control system for wells having offset or branch bores penetrating isolated subsurface hydrocarbon production zones and which provides for zonal isolation control so that the well can be produced selectively from one or more, of the subsurface zones in an independent manner.

It is another feature of the present invention to provide a novel retrievable zonal isolation control system having isolation control apparatus that is located within respective isolation mandrels permanently attached in the well production tubing and which have sensor or control modules which may be installed and retrieved by wire-line equipment.

An additional advantage of the system of the invention is that larger total well control packages than usual may be employed without fear of failure, since individual components can be replaced in situ.

It is a further feature of the present invention to provide a novel retrievable zonal isolation control system for multiple offset or branch wells wherein control valves therefor may be in the form of rotary valves, sliding sleeve valves, gate valves or another suitable valve type and wherein the valves may be hydraulically or electrically actuated and electrically controlled via electric wire lines extending to surface control equipment or are controlled in situ in a well by power sources, such as replaceable batteries, that are located onboard the respective zonal isolation control apparatus.

Another feature of the present invention is to provide a novel retrievable zonal isolation control system having electronic circuitry and being capable of being installed within and being retrievable inside production tubing from a permanently emplaced bottom entry mandrel which has a wet-connect, and/or inductive or capacitive type electrical connection for electrically connecting the circuitry to electrical conductors that extend to the surface or from component module to component module of the system.

BRIEF DESCRIPTION OF THE INVENTION

Briefly, the system of the present invention provides the above referenced and other features in a through tubing sized set of electronic sensor, power, and control modules which may be set in the wellbore or retrieved therefrom by the use of a kick over tool into a permanently installed side pocket mandrel equipped section of tubing. The well to be controlled is drilled and cased to the desired depth of one or more producing zones. It will be understood by those of skill in the art that each potential hydrocarbon producing zone in the well is penetrated by the main, or an offset or branch bore, as previously described. Each zone is penetrated by one or more strings of production tubing. The hydrocarbon producing zones are isolated from fluid communication with each other inside the well casing or the borehole by sets of packers or plugs run into the well on the production tubing. Also permanently installed and carried by the production tubing are one or more side pocket mandrels which may be selectively placed in fluid and pressure communication with the casing/tubing or borehole/tubing annulus in the production zone in which they are located. These side pocket mandrels are equipped with wet connectors which can be used to establish electrical connection to power instruments and control modules which may be placed into their side pockets, or retrieved from them, by use of a kick over tool which may be run into the well tubing on a wire line. The permanently emplaced side pocket mandrels are also electrically interconnected to each other and to the surface if desired via electric wire lines which are run into the well attached to the production tubing. They may also have a hydraulic line connection to each other and possibly to the surface, which may also be run into the well on the production tubing. Isolation control modules or subs may also be run into the well via the kick over tool and installed or retrieved from the side pocket mandrels. Ball valve subs, sliding sleeve valve subs, flapper valve subs, rotary valve subs, linear valve subs, rotary plunger valve subs and in general, any type of fluid flow control valve sub may be placed in the well in a side pocket mandrel in this manner.

Also, modules for controlling production tubing carried hydraulic systems powered by downhole electrical motor powered hydraulic pumps are contemplated in the system of the invention. While such pumps may be too large to pass through tubing themselves and may be permanently carried by the tubing, their control may be provided by through tubing sized electronic modules placed in nearby side pocket mandrels. Such hydraulic fluid pumps (electrically powered) may be used, for example, to inflate or deflate resettable cased hole or open hole packers used in zonal isolation. Such hydraulic pump control modules (or other control modules) may be thought of as the "brain" of the control system while the pumps, packers, valves, etc. controlled by them may be thought of as the "muscle" of the system.

In operation, when the well is completed and the production tubing run in, the packers or plugs are set isolating the various producing zones. The downhole instrument and control modules measure the casing/annulus or borehole/annulus and tubing pressures and supply the data via wireline to a control computer, located either at the surface of the earth or in one or more of the downhole modules. The control computer determines the fluid flow conditions in each isolated zone and sends control signals out to the valve module for that zone. Each valve module opens, adjusts, or stops fluid flow from the casing/tubing or borehole/tubing annulus into the production tubing in response to this control signal.

The operation of the system is best understood by reference to the following detailed description when taken is conjunction with the accompanying drawings which are illustrative and not limitative of the invention.

DETAILED DESCRIPTION OF PREFERRED EMBODIMENTS

Figure 1:
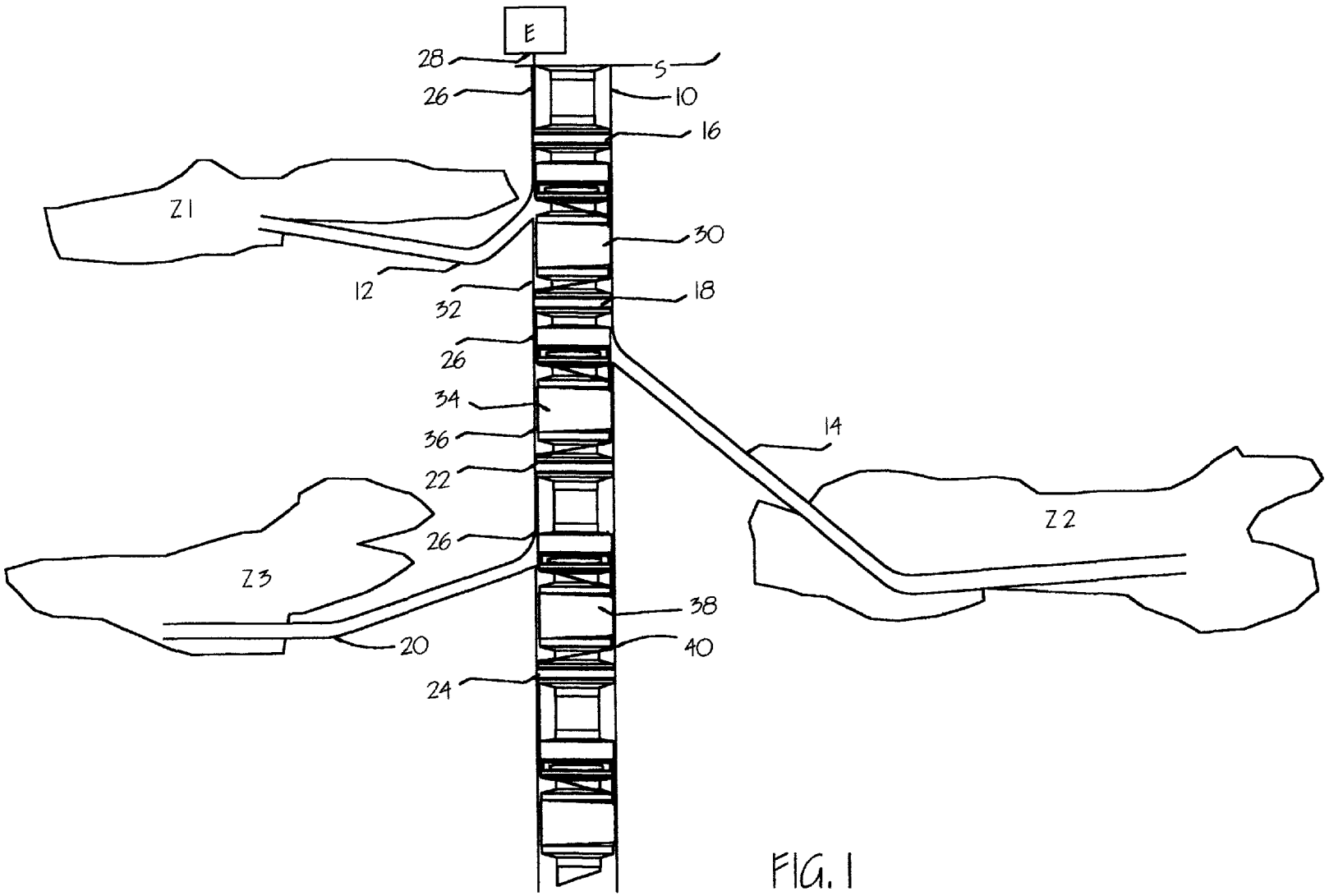
FIG. 1 is a schematic illustration of a well having a primary wellbore extending vertically from the surface and offset or branch wellbores extending from the primary wellbore to independent subsurface zones of interest and further showing a system according to the present invention for selectively controlling production from one or more zones while maintaining selective isolation of the zones from one another.

Prior to describing in detail several specific embodiments for the system of the invention, the concepts of the invention are placed in their proper context. In completing a well for hydrocarbon production whether a multi zonal vertical completion, or a multi lateral or branch well completion, several steps must be taken which do not necessarily comprise a part of the present invention. For example, and for simplicity, assume a multi zonal vertical well completion. The borehole is drilled to and through each zone of interest for prospective hydrocarbon production. As it is drilled, wireline well logs are usually periodically run in the open hole to determine formation characteristics of the formations penetrated by the wellbore. When total depth is reached (and perhaps in several stages during the drilling operation) well casing is placed in the hole and cemented in place. The well is then typically wireline logged through the casing to confirm prospective hydrocarbon producing zones and then perforating guns are lowered (either on wireline, coiled tubing, or production tubing) and used to perforate the casing and cement sheath to "open up" production zones to the cased wellbore The "production string" of tubing is then run into the well and carries with it appropriate packers and/or plugs to isolate each prospective producing zone from fluid communication within the casing or borehole. The packers and plugs are then set in place, along with the completion tool string, including the permanently installed side pocket mandrels and their contents, of the present invention. Thus each producing zone is isolated within the casing or the borehole by packers and/or plugs and the production tubing string and associated completion tools are in place to control the flow of produced fluid from the casing/tubing or borehole/tubing annulus (where it enters via the perforation) into the production tubing. Assuming enough formation pressure is in each production zone to lift the produced fluids to the surface via the production tubing string, then the well will produce hydrocarbonaceous fluids to the surface via the production tubing As the well ages it can lose gas pressure or water drive pressure due to formation depletion. If the formation pressure is water drive rather than gas, it can lose drive pressure also due to pressure depletion of the water drive. In any event, it is desirable to the able to control the flow of fluid from each zonal isolated producing zone into the production tubing from the casing/tubing or borehole/tubing annulus. This has heretofore been accomplished by, typically, pulling the production tubing string and placing new valves of different orifice size in the zones of interest to vary fluid flow into the tubing. In some instances it may be necessary to move or change packer/plug locations or even to re-perforate the zone or seal off existing perforations as by a "cement squeeze" job through the perforations.

As pulling the well tubing can be very expensive and tine consuming, it is highly desirable to be able to control zonal isolation and fluid flow from a producing zone in a multi zone completion without removing the production tubing string. The system of the present invention allows this by the placement of monitor/control modules (or subs) in appropriate positions in the well and by allowing the replacement and/or control of valves and packers in each controlled producing zone without pulling the tubing string out of the well.

Through tubing sized electronic "brain" modules or subs may be run into (or out of) the well inside the production tubing with use of the side pocket mandrels and kick over tools of the system of the invention. Side pocket mandrels of the type shown in U.S. Pat. No. 5,740,860 are suitable for this purpose and this patent is incorporated herein by reference for all purposes. A suitable kick over tool is that shown in U.S. Pat. No. 4,976,314. This patent is also incorporated by reference herein for all purposes.

Referring now to the drawings and first FIG. 1, the schematic illustration depicts a primary wellbore 10 in a multi lateral or branch completion extending vertically from the Earth's surface S. At a desired wellbore depth, 8,000 feet for example as shown, a branch or offset wellbore 12 is drilled from the primary wellbore outwardly to a subsurface zone $Z_1$ of interest. Below the branch bore 12 another branch or offset bore 14 maybe drilled from the primary wellbore to another subsurface zone $Z_2$ of interest. Isolation devices 16 and 18 which typically include packers, plugs and control valves are set within the casing of the primary wellbore to isolate the branch bores 12 and 14 from one another. With the branch bores isolated, the production fluid from the respective subsurface zones $Z_1$, and $Z_2$ will not become commingled if it is desired to maintain them isolated from one another. Moreover, the subsurface production zones $Z_1$ and $Z_2$ will, in general, be at different pressures so that a tendency could exist for fluid, such as crude oil, natural gas and water to flow from the higher pressure into the lower pressure zone, perhaps damaging the production formation of the lower pressure zone. To prevent pressurized fluid from a higher pressure zone from flowing into a lower pressure zone, zonal isolation is desired.

As shown at the lower portion of FIG. 1, another branch line 20 may be drilled from the primary wellbore to yet another isolated subsurface zone $Z_3$ of interest. Zonal control devices such as valve assembly having packers 22 and 24 are typically set within the casing of the primary wellbore to assist in isolating the subsurface zone $Z_3$ from all other zones that are intersected by branch bores extending from the primary wellbore. It will be understood, of course, that production tubing extends to the surface S, penetrating packer used in zonal isolation as necessary to conduct produced fluids to the surface.

Assuming it is always desired to maintain the subsurface zones isolated from one another, each of the wellbores or well sections in communication with the respective subsurface zones $Z_1$–$Z_3$ will be provided with a valve control isolation system that may be controlled from the surface. Accordingly an electrical cable 26 is provided which is connected at its upper end 28 to a source E of electric power and control, such as a control computer, and which extends downwardly to a zonal isolation control assembly shown generally at 30. The zonal isolation control assembly may be located within the primary wellbore section 32 or located within branch bore 12 as desired. Likewise, the electrical cable 26 extends further downward to a second zonal isolation control system shown generally at 34 and being located either in the main branch line section 36 or within the branch bore 14. The electrical cable 26 extends downwardly and is connected for power and control with other zonal isolation control systems shown generally 38. This zonal isolation control system may be located within the primary wellbore section 40 or within in branch bore 20 as desired. Hydraulic fluid tubes may also be provided paralleling the electrical cables, if desired.

Figure 2:
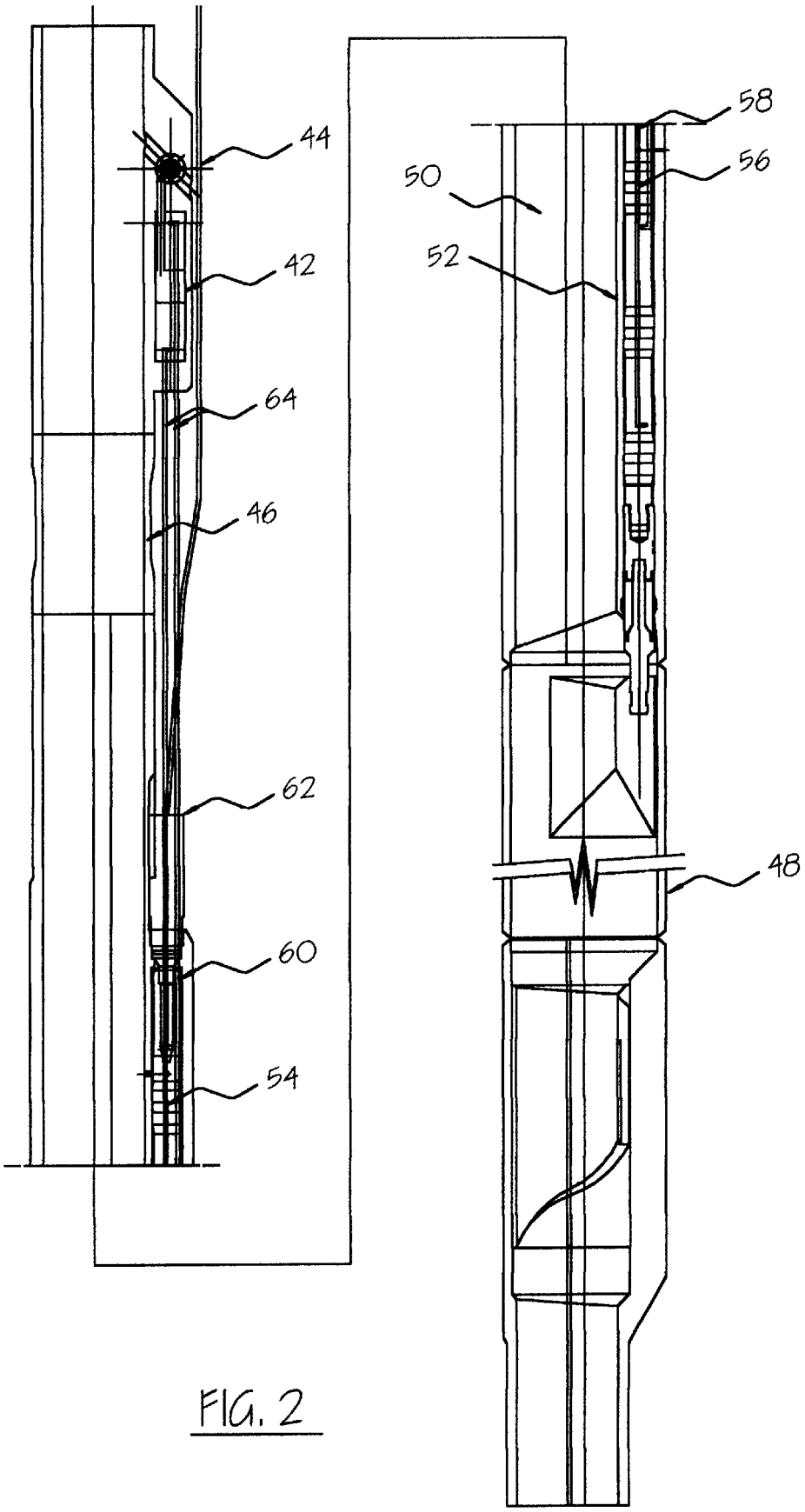
FIG. 2 is a schematic illustration of a single side pocket mandrel of the zonal isolation control system hereof, showing a ball valve type flow control module or sub being adapted for hydraulic opening and closing movement and showing a retrievable electronic module located within the side pocket mandrel, electrically connected with control circuitry and having a hydraulic system for controlling opening and closing movement of the isolation valve.

Referring now to FIG. 2, each of the zonal isolation control systems 30, 34, and 38 includes a valve module or sub 42 which may include a valve 44 which is designed for hydraulic opening and closing actuation. This invention may include rotary ball type isolation valves, electrically energized, or hydraulically actuated sleeve valves, gate valves or other suitable types of valves that may be employed as isolation valves without departing from the spirit and scope of this invention. The valve 44 is coupled by a pup joint 46 to a controller instrument located in mandrel 48. The mandrel 48 is a component of the production tubing string of the well and has an internal flow passage 50 through which fluid is permitted to flow from the selected subsurface zone. Within the mandrel 48 is a side pocket 52 having an internal polished surface section for sealing engagement by seals 54 and 56 of a zonal isolation control tool 58 in the form of a differential pressure sensor electronic module or package having pressure sensors and perhaps other sensors, such as temperature sensors as desired, for sensing various properties of the production fluid entering the branch bores or primary wellbore from selected subsurface zones. The tool also includes a linear motion device to develop hydraulic fluid pressure which provides pressure induced opening or closing force for the valve 44 of the valve sub. The tool 58 is also provided with an electrical connector 60 which is received by a wet-connect type electrical connector 62 in mandrel 48 to establish electrical connection with the position sensing system of the valve 44. The tool 58 also establishes fluid connection with hydraulic opening and closing lines or passages 64 that are operatively coupled with valve sub 42 for hydraulically energized operation (opening or closing) of the valve 44.

Figure 3:
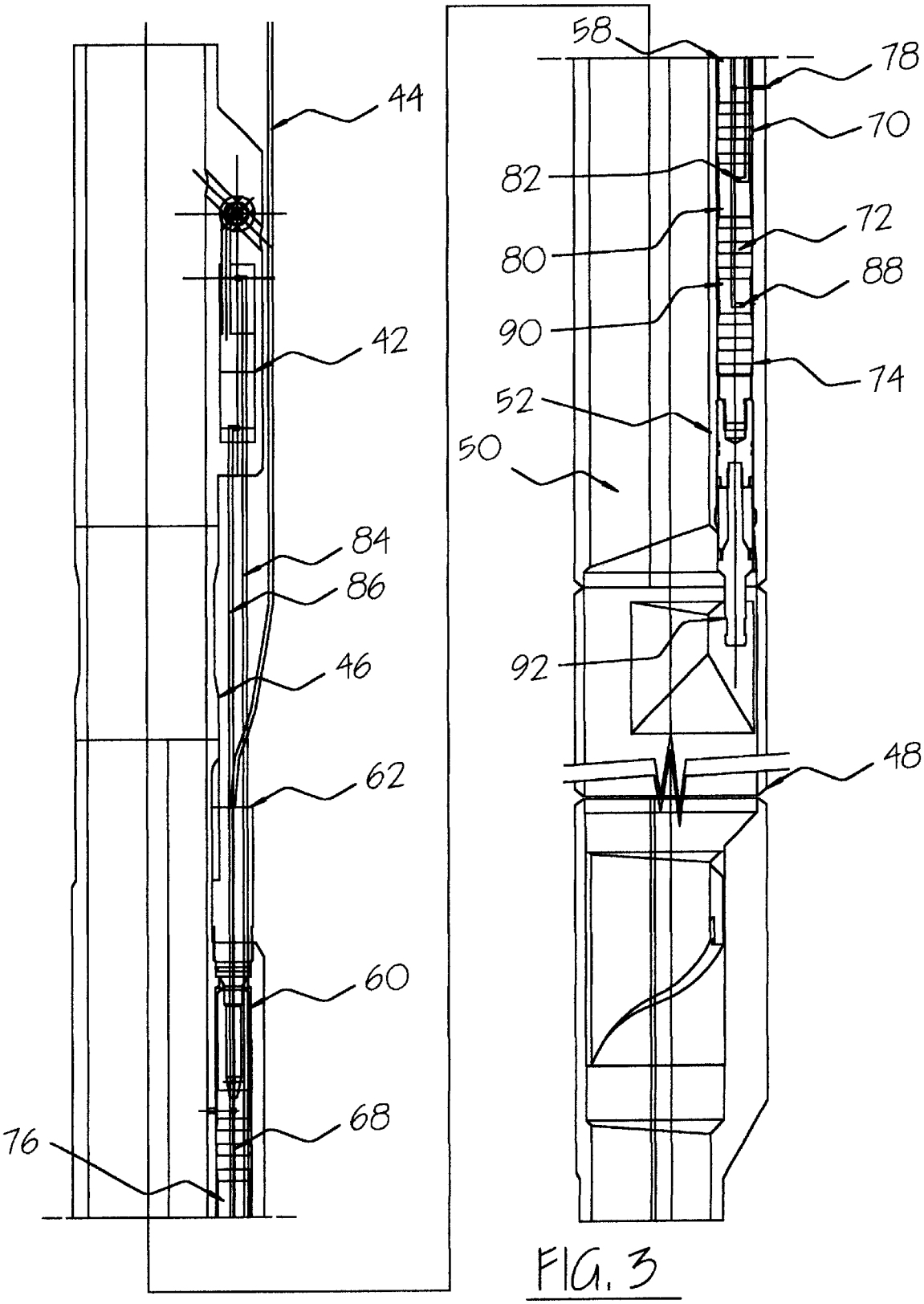
FIG. 3 is a schematic illustration of the zonal isolation control tool of FIG. 2, having a linearly moveable sleeve type zone control valve and showing its wet-connector, polished surface to permit sealing of the tool internally of the side pocket of the mandrel, seals for sealing within the mandrel and a latch mechanism for latching the tool within the side pocket of the mandrel.

Referring now to FIG. 3, the zonal isolation control tool 58 is of an elongate configuration and is adapted to be received within the side pocket 52 of the mandrel as shown in FIG. 2. The tool 58 incorporates external packings 68, 70, 72 and 74 which engage respective internal polished sealing surfaces of the side pocket, with the wet-connect type electrical connector 60 projecting above the upper packing 68 and adapted for electrical connection with the circuit connector 62 shown in FIG. 2. Between the packings 68 and 70, there is provided an electronic package 76 within the tool. Well fluid pressure that is present within the casing/tubing annulus between the packings is communicated within the tool for pressure sensing by the electronic package via a casing pressure sensing port 78. From the standpoint of opening and closing movement of the isolation valve, whether it is in the form of a ball valve, sleeve valve, gate value, or the like, the tool section 80 between the packings 70 and 72 defines a "valve open" port 82 that is communicated by a hydraulic control line or passage 84 with the isolation valve in a manner wherein hydraulic pressure in the line 84 will cause opening movement of the isolation valve. Closing movement of the isolation valve 44 is accomplished via a "valve close" hydraulic fluid line or passage 86 which is communicated via a valve close port 88 that is located within tool section 90 between the packing elements 72 and 74.

For securing the tool 58 within the side pocket 52 of the mandrel 48 in the manner shown in FIG. 2, the lower portion of the tool is defined by a latch mechanism 92 that is adapted for latching engagement with an internal latch profile that is defined within the lower portion of the side pocket of the mandrel.

Figure 4:
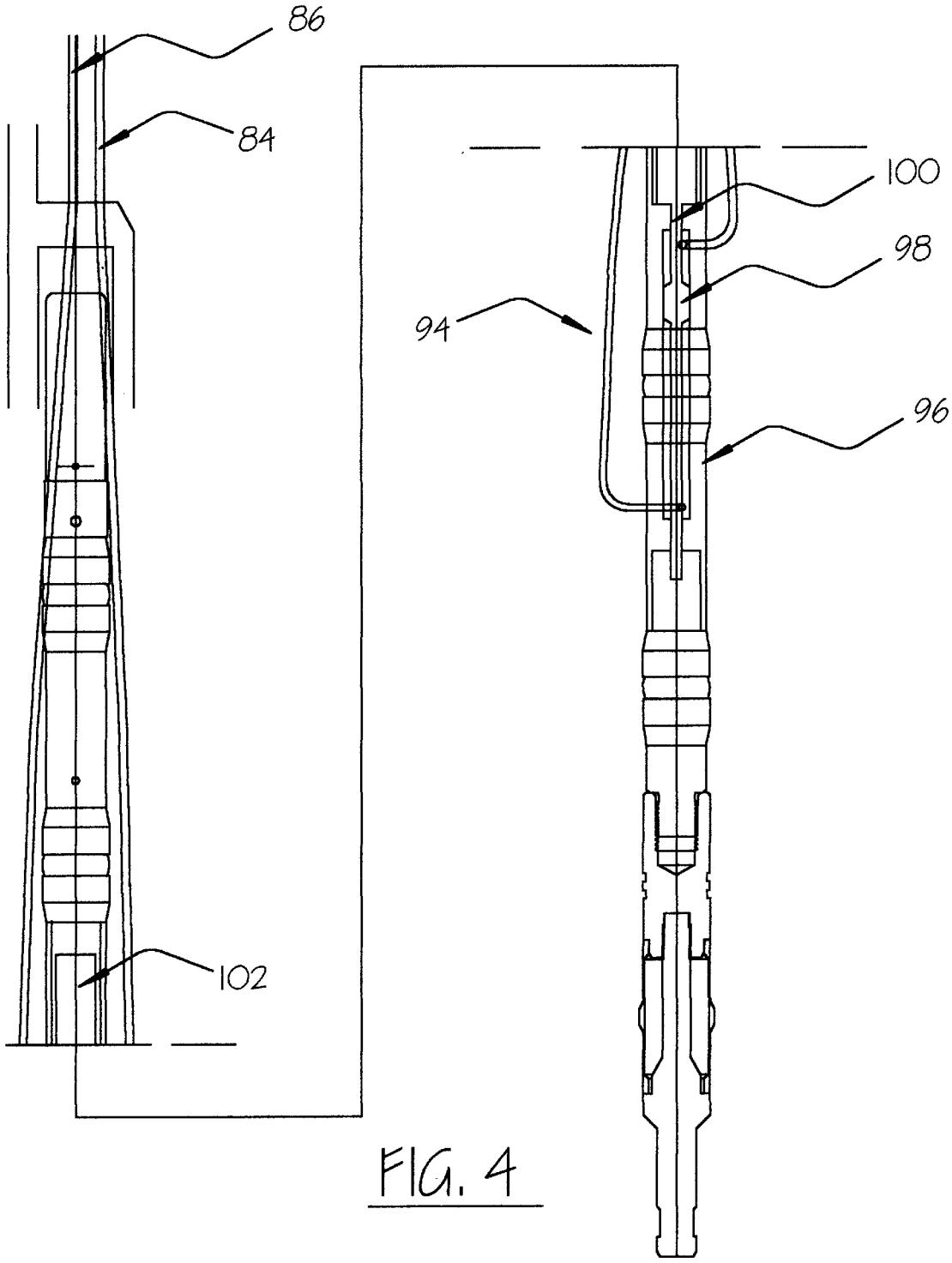
FIG. 4 is a schematic illustration in section, showing moveable plunger, moveable by linear or rotary actuation, and having hydraulic "open" and "close" passages through which hydraulic fluid is conducted for valve actuation.

With reference now to FIG. 4, for the purpose of imparting opening or closing movement to the isolation valve mechanism, a hydraulic actuator is shown generally at 94 and comprises a hydraulic cylinder 96 having a piston 98 moveably deposed therein. The piston is linearly moveable within the cylinder by an elongate plunger 100. The plunger is moveable by a plunger actuator 102 that is electrically operated. The plunger actuator may be of the linear type, such as may be defined by a solenoid mechanism or it may conveniently take the form of a rotary type, such as being in the form of a rotary electric motor driving a threaded element having threaded engagement with the plunger 100. In this case, rotation of the threaded drive element will impart linear movement to the plunger member and will develop significant hydraulic pressure of achieving opening and closing movement of the zonal isolation valve 44, shown ion FIG. 3. Other types of electrically energized actuators may be also utilized for moving the plunger linearly to thus move the piston 98 linearly within the cylinder 96. When the plunger is moved upwardly, hydraulic pressure is increased in the hydraulic line 84 causing forcible opening of the isolation valve. In the alternative, when the plunger moves the piston downwardly hydraulic pressure is increased in the flow line or passage 86 thereby forcibly closing the isolation valve.

Figure 5:
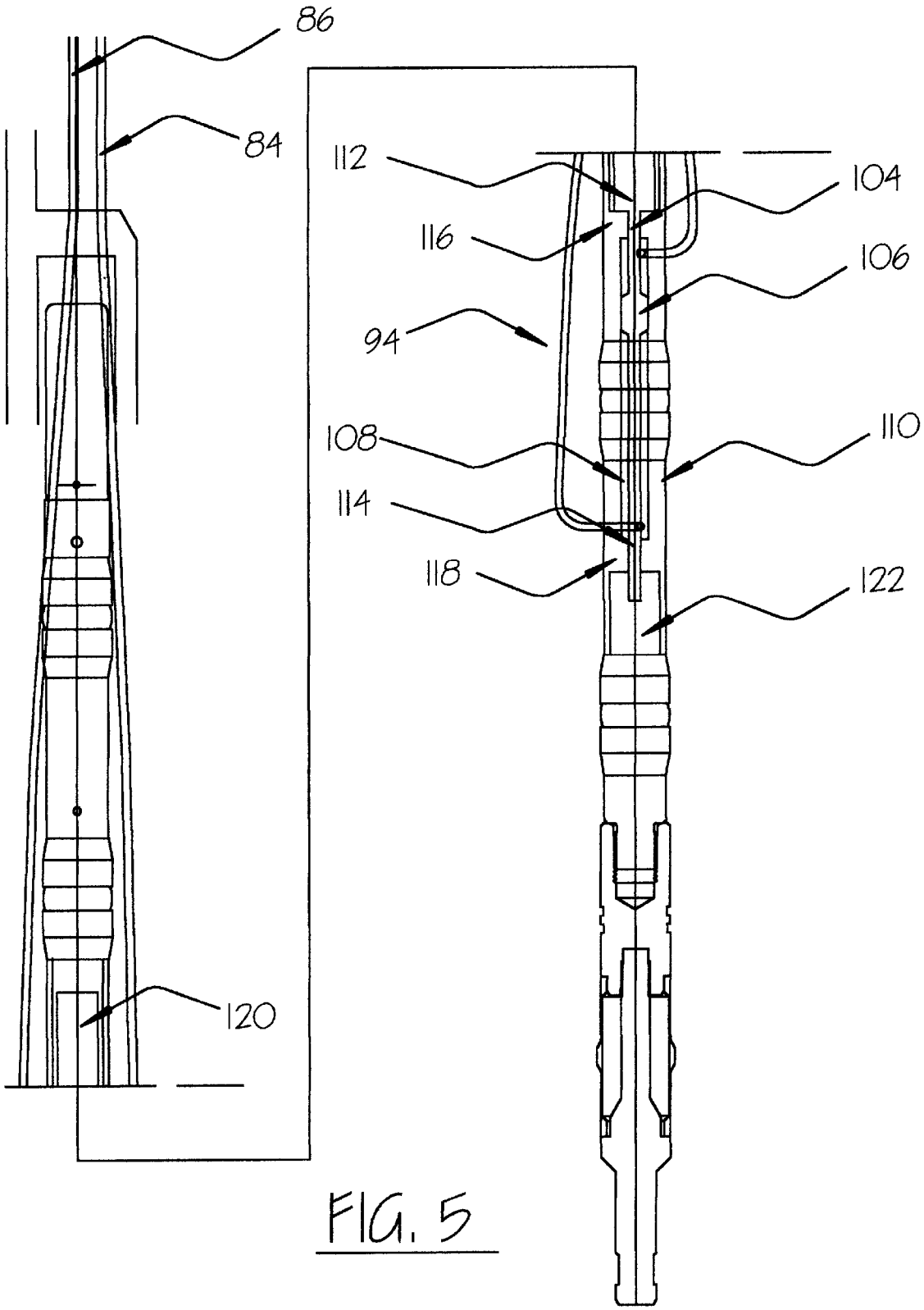
FIG. 5 is a schematic illustration in section showing a plunger actuated piston and housing assembly and having one or more actuators for "opening" and "closing" movement of the plunger and piston and FIG. 6 is an end view of the side pocket mandrel showing hydraulic fluid passages and electrical conductor passages.

As shown in FIG. 5, an alternative embodiment of the invention may incorporate a linearly moveable plunger 104 that moves a piston 106 linearly within the piston chamber 108 of a plunger housing or cylinder 110. Opposite ends 112 and 114 of the plunger may extend through passages defined in respective end walls 116 and 118 of the cylinder, thus permitting the plunger to be actuated by an electrically energized power mechanism located externally of the cylinder. If desired, plunger actuator 120 may impart opening and closing movement to the plunger. In the alternative, one plunge actuator may impart opening movement to the plunger while another plunger actuator 122 may impart closing movement to the plunger.

Figure 6:
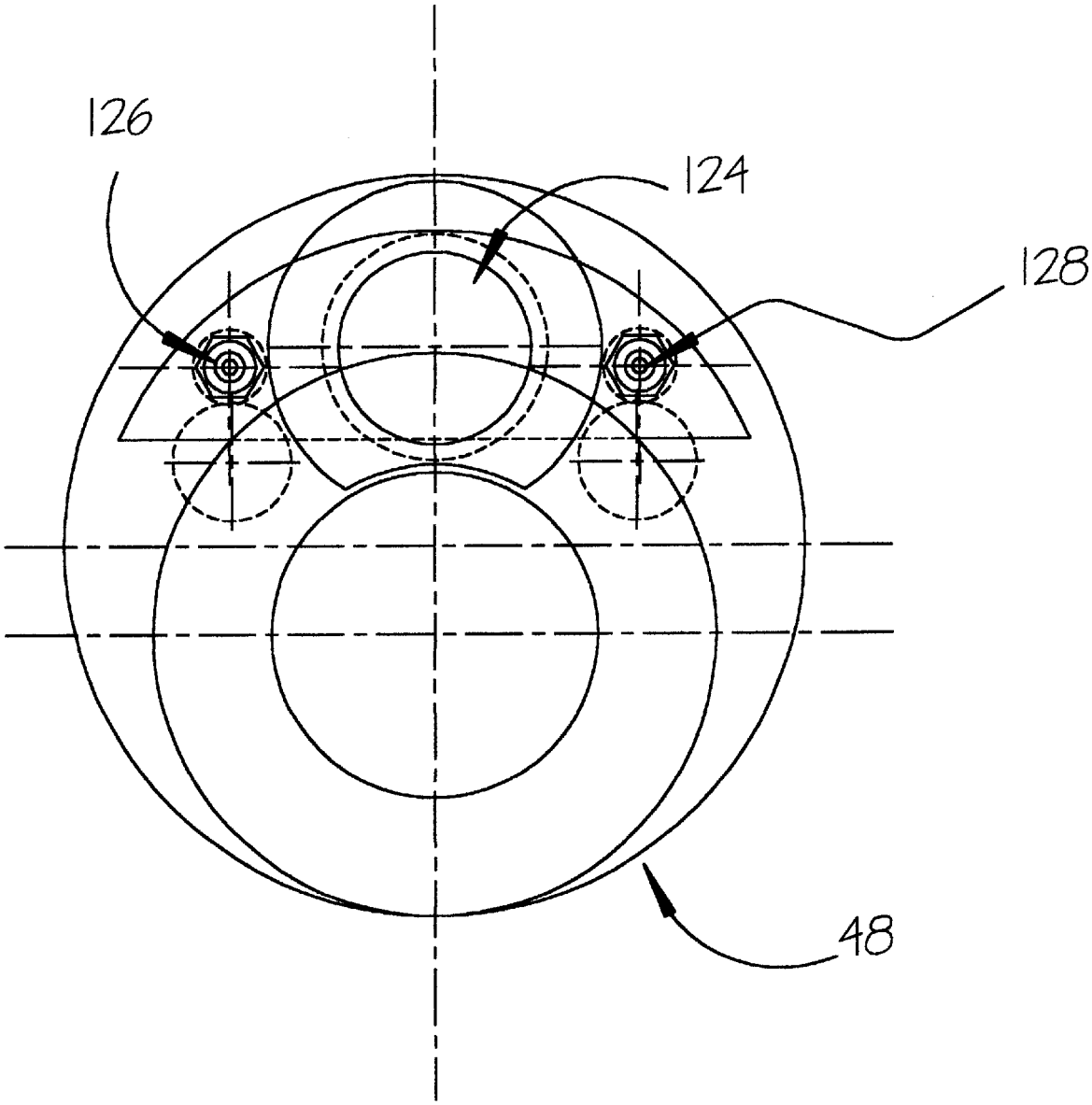

Referring now to FIG. 6, for purpose of electrical and hydraulic control of the zonal isolation system the mandrel 48 may be drilled or otherwise formed to define an electric cable passage 124 and hydraulic fluid passages 126 and 128. It should be borne in mind however, that the electric cable passage 124 and the hydraulic passages 126 and 128 may be defined internally of the mandrel wall structure or may be defined by conduits located externally of the mandrel structure without departing from the spirit and scope of this invention.

The foregoing descriptions may make other modifications of the inventive concepts apparent to those of skill in the art. It is the aim of the appended claims to cover all such changes and modifications which fall within the true spirit and scope of the invention.

What is claimed is:

1. A system for monitoring and controlling fluid flow from one or more isolated hydrocarbon producing-zones in a borehole, comprising:

at least one through tubing sized, electrically powered, flow monitor and control module for measuring fluid flow properties in a cased well borehole, said module being housed in a side pocket of at least one permanent installed mandrel section of a production tubing string in the borehole; and at least one isolation valve module carried by said at least one mandrel for regulating fluid flow from the annulus in said isolated hydrocarbon producing zone to the interior of the production tubing string, wherein said control module actuates said isolation valve module from said side pocket of said mandrel.

2. The system of claim 1 and further including a means for generating a flow control signal in response to measurements of fluid flow properties.

3. The system of claim 2 wherein said means for generating a flow control signal is located downhole in a permanently installed side pocket mandrel.

4. The system of claim 2 wherein said means for generating flow control signal is located at the surface of the earth.

5. The system of claim 1 wherein a plurality of flow monitor and control modules and isolation valve modules are placed in plural isolated hydrocarbon producing zones in a one to one relationship therewith.

6. The system claim 1 wherein either of said modules are placable in or retrievable from said mandrel section by use of a through tubing kick over tool.

7. The system of claim 5 wherein said mandrel sections comprise bottom entry mandrel sections.

8. The system of claim 7 wherein said mandrel sections each contain a down facing electrical wet connector.

9. The system of claim 8 wherein said mandrel sections are electrically interconnected.

10. The system of claim 9 wherein said mandrel sections are hydraulic fluid line interconnected.

11. The system of claim 1 wherein said isolation valve module comprises a rotary valve module.

12. The system of claim 1 wherein said isolation valve module comprises a sliding sleeve valve.

13. The system of claim 1 wherein said isolation valve module comprises a gate valve module.

14. The system of claim 1 wherein said isolation valve module comprises a ball valve module.

15. The system of claim 1 wherein said isolation valve module controls a hydraulic fluid pump module for inflating or deflating a resettable packer.

16. The system of claim 1 and further including a retrievable downhole power source module carried in a side pocket mandrel section.

17. The system of claim 16 wherein said downhole power source module is a battery power module.

18. The system of claim 1 wherein said control module comprises:

a cylinder;

a piston disposed within said cylinder;

a plunger coupled to said piston; and a plunger actuator that moves said piston within said cylinder and pressurizes fluid to actuate said isolation valve module.

19. The system of claim 1 further comprising at least one conduit coupled to said cylinder to receive fluid from said cylinder and coupled to the isolation valve module for flowing fluid therethrough to selectively move said isolation valve module.

20. A system for monitoring and controlling fluid flow from one or more isolated hydrocarbon producing zones in a borehole, comprising:

a mandrel mountable in said borehole; and at least one through tubing sized control module mountable in said mandrel, comprising:

a cylinder;

a piston disposed within said cylinder;

a plunger coupled to said piston; and a plunger actuator that moves said piston within said cylinder.

21. The system of claim 20 and further including at least one isolation valve module coupled to said mandrel, said isolation valve being controlled by said control module.

22. The system of claim 21 wherein said mandrel comprises a side pocket and said control module is at least partially mountable therein.

23. The system of claim 22 wherein said mandrel, said control valve and said isolation valve module are mounted in said borehole between two isolation devices separating a zone from at least one other zone.

24. A system for monitoring and controlling fluid flow from one or more isolated hydrocarbon producing zones in a borehole, comprising:

a side pocket mandrel mountable in said borehole;

at least one through tubing sized control module mounted in said side pocket of said mandrel; and at least one isolation valve module coupled to said mandrel, said mandrel being controlled by said control module.

25. The system of claim 24 wherein said control module further includes:

a cylinder;

a piston disposed within said cylinder;

a plunger coupled to said piston; and a plunger actuator that moves said piston within said cylinder.

26. The system of claim 24 wherein the control module is wireline retrievable from said side pocket in said mandrel when said control module is disposed downhole in the borehole in said side pocket.

* * * * *